US006604981B1

(12) United States Patent
Sheng-Hung

(10) Patent No.: US 6,604,981 B1
(45) Date of Patent: Aug. 12, 2003

(54) ANIMATED TOY ANIMAL

(75) Inventor: Hsu Sheng-Hung, Kaohsiung Hsieh (TW)

(73) Assignee: Gemmy Industries, Inc., Irving, TX (US)

( * ) Notice: Subject to any disclaimer, the term of this patent is extended or adjusted under 35 U.S.C. 154(b) by 0 days.

(21) Appl. No.: 09/781,518

(22) Filed: Apr. 12, 2001

(51) Int. Cl.[7] ..... A63H 3/28
(52) U.S. Cl. ..... 446/338; 446/353; 446/391
(58) Field of Search ..... 446/297, 298, 446/299, 300, 301, 330, 337, 338, 352, 353, 395

(56) References Cited

U.S. PATENT DOCUMENTS 5,108,341 A * 4/1992 DeSmet ..... 446/299
6,315,631 B1 * 11/2001 Beckman et al. ..... 446/297

* cited by examiner

*Primary Examiner*—Jacob K. Ackun

(57) ABSTRACT

An animated toy animal includes a hollow shell having a body part and a head part. The head part has an upper mandible and a lower mandible movable relative to the upper mandible. A neckerchief extends downward from the head part to conceal a seam between the parts. A device is arranged in the body part for wagging the head part side to side relative to the body part, and another device is arranged in the head part for moving the lower mandible upward and downward relative to the upper mandible.

12 Claims, 3 Drawing Sheets

ANIMATED TOY ANIMAL

BACKGROUND OF THE INVENTION

1. Field of the Invention

The present invention relates to a toy animal and, more particularly, to an animated toy animal.

2. Description of the Prior Art

Many toys are designed to take the form of animals, such as a bird, bear, dog and the like. Popularity of these toys, generally referred as toy animals, quickly wanes because the are generally solid and inactive. Although other toy animals are active, they have respective seams between their movable parts and main bodies which are unsightly.

Therefore, it is an objective of the invention to provide an animated toy animal to mitigate and/or obviate the aforementioned problems.

BRIEF SUMMARY OF THE INVENTION

The object of the present invention is to provide an animated toy animal in which a head part can be wagged side to side and a lower mandible can be moved upward and downward.

Another object of the present invention is to provide an animated toy animal in which a seam between the movable head part and a body is concealed.

In accordance with a preferred embodiment of the present invention, an animated toy animal comprises a hollow shell configured as a real animal and having a body part and a head part, said head part having an upper mandible and a lower mandible movable relative to said upper mandible, a neckerchief extending downward from said head part to conceal a seam between said parts, means arranged in said body part for wagging said head part side to side relative to said body part, and means arranged in said head part for moving said lower mandible upward and downward relative to said upper mandible.

Other objects, advantages and novel features of the utility model will become more apparent from the following detailed description when taken in conjunction with the accompanying drawings.

BRIEF DESCRIPTION OF THE SEVERAL VIEWS OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention. In the drawings.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

DETAILED DESCRIPTION OF THE INVENTION

Detailed description of the preferred embodiment is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The figures show a preferred embodiment of an animated toy animal in accordance with the present invention. The toy animal may be configured as any real animal though the particular configuration of a toy bird is shown and described hereinafter.

Figure 1:
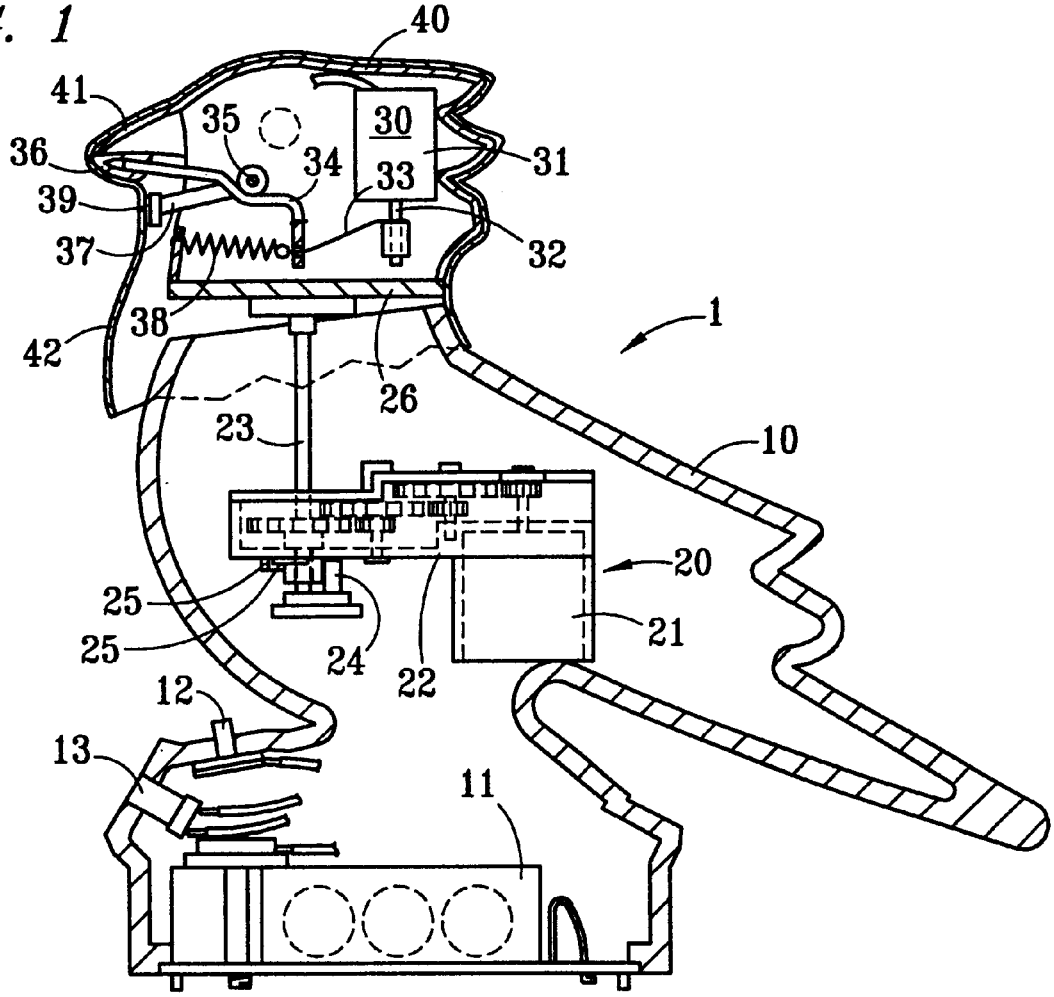
FIG. 1 is cross-sectional side view of a preferred embodiment of an animated toy animal in accordance with the present invention.

Referring to FIG. 1, the animated toy animal includes hollow shell 1 configured as a real bird. Shell 1 includes body part 10 and head part 40, with head part 40 having upper mandible 41 and lower mandible 36. Neckerchief 42 extends downward from head part 40 to conceal a seam between body part 10 and head part 40.

In body part 10 there is provided means 20 for wagging head part 40 side to side relative to body part 10. In the illustrated embodiment, means 20 for wagging includes disk 26 for supporting head part 40, upright axle 23 connected at a top end thereof to disk 26, and reciprocating motor 21 to drive upright axle 23 side to side relative to body part 10 through speed reducer 22.

Figure 2:
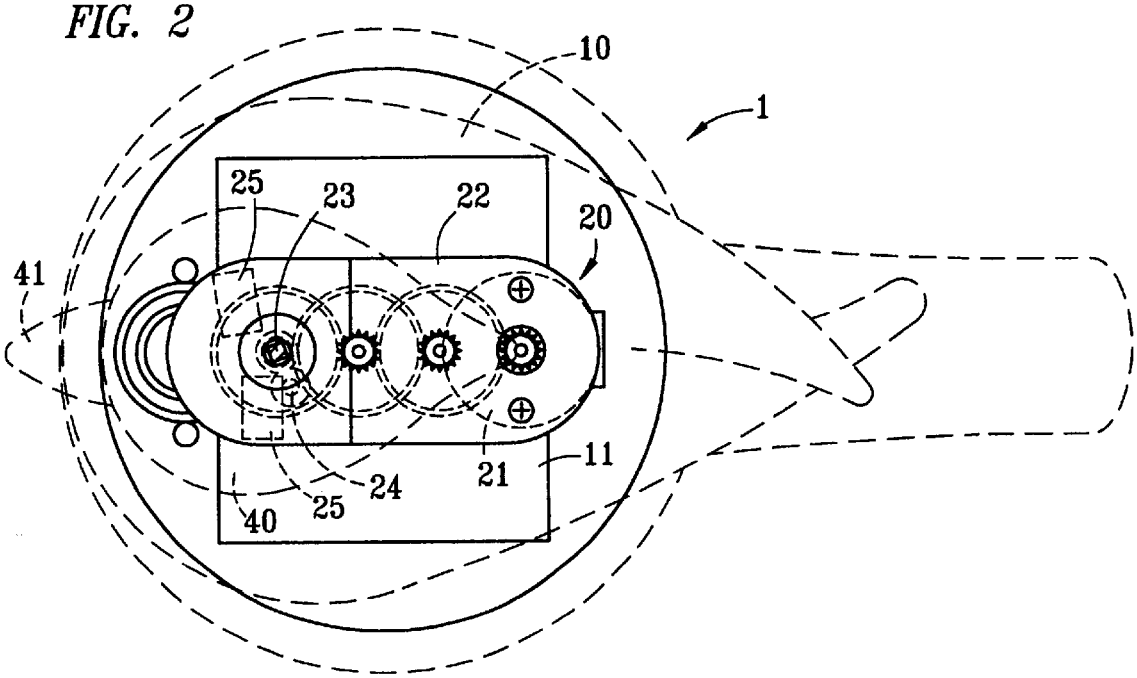
FIG. 2 is a top view of the animated toy animal of FIG. 1.

Preferably, upright axle 23 has stub 24 formed at a bottom end thereof, while speed reducer 22 has a pair of spaced stops 25 engageable with stub 24, thereby limiting the rotation of shaft 23 and hence head part 40 to a predetermined angular range, as best shown in FIG. 2.

Referring back to FIG. 1, in head part 40 there is provided means 30 for moving lower mandible 36 upward and downward relative to upper mandible 41. In the illustrated embodiment, means 30 for moving lower mandible 36 includes lever 34 and rotary motor 31. Lever 34 has a first end and a second end. Lever 34 is pivoted on head part 40 between the ends by pin 35 and is connected at the first end to lower mandible 36. Cord 33 is stretched between the second end of lever 33 and spindle 32 of rotary motor 31, and spring element 38 is stretched between the second end of lever 34 and an inner wall of head body 40.

Lever 34 may additionally include branch 37 that has a distal end attached to neckerchief 42 in a location below lower mandible 36, preferably through a piece of soft material 39 intervening between the distal end and neckerchief 42.

Furthermore, electrical power supply 11 and switch 12 are disposed in body part 10. Power supply 11 is electrically connected, via switch 12, to motors 21, 31 for supplying them with electric energy.

If switch 12 is pressed down, head part 40 is wagged side to side and lower mandible 36 is moved upward and downward, in harmony with the rhythm of a tune or repeated twittering sounds played under the control of an electrical circuit, not shown, housed in shell 1.

Figure 3:
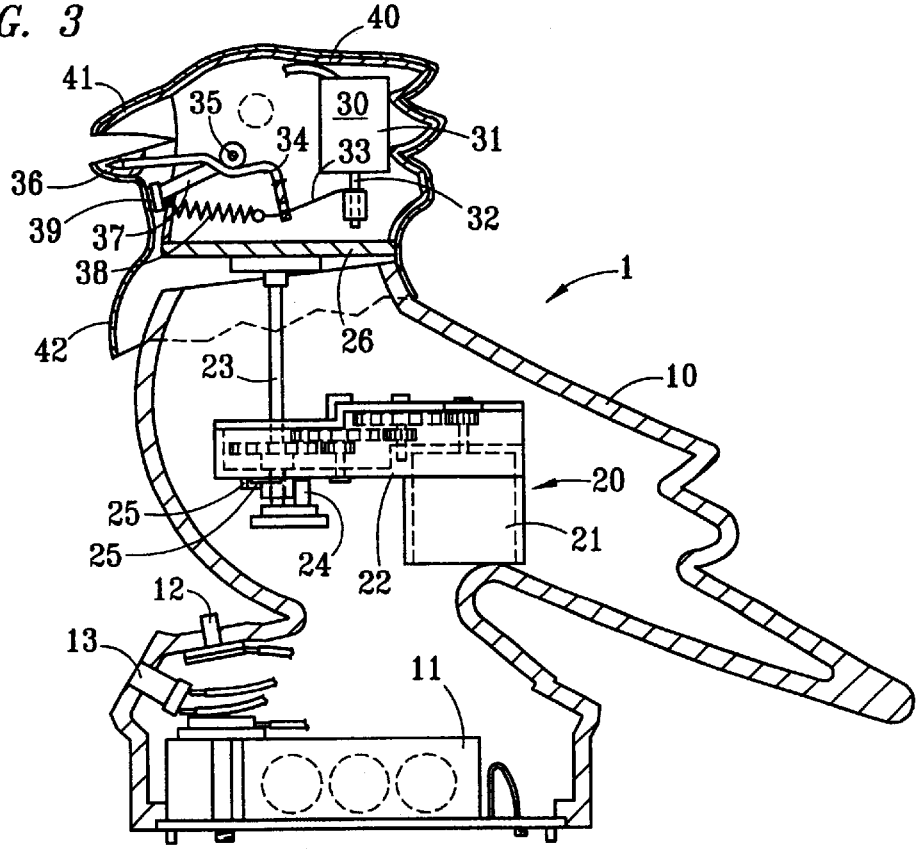
FIG. 3 is a cross-sectional side view of the animated toy animal of FIG. 1, showing the toy animal opening its mandibles.

Lower mandible 36 is moved relative to upper mandible 41 because lever 34 is rotated about pin 35 alternately by rotary motor 31, which rotates lever 34 counterclockwise through cord 33, and by spring 38, which rotates lever 34 clockwise. Due to the rotations of lever 34 in the opposite directions, lower mandible 36 is moved upward and downward, as if the artificial bird repeatedly opens and shuts its mandibles 36, 41, as shown in FIGS. 3 and 1.

While the artificial bird opens its mandibles 36, 41, i.e. lever 34 is rotated counterclockwise, the distal end of branch 37 pulls neckerchief 42 backward to that a more distinct recess may appear at the throat or below lower mandible 36. Furthermore, the piece of soft material 39 vibrates as the vocal cord of a real bird does, thus making the artificial bird seem much more alive.

Figure 4:
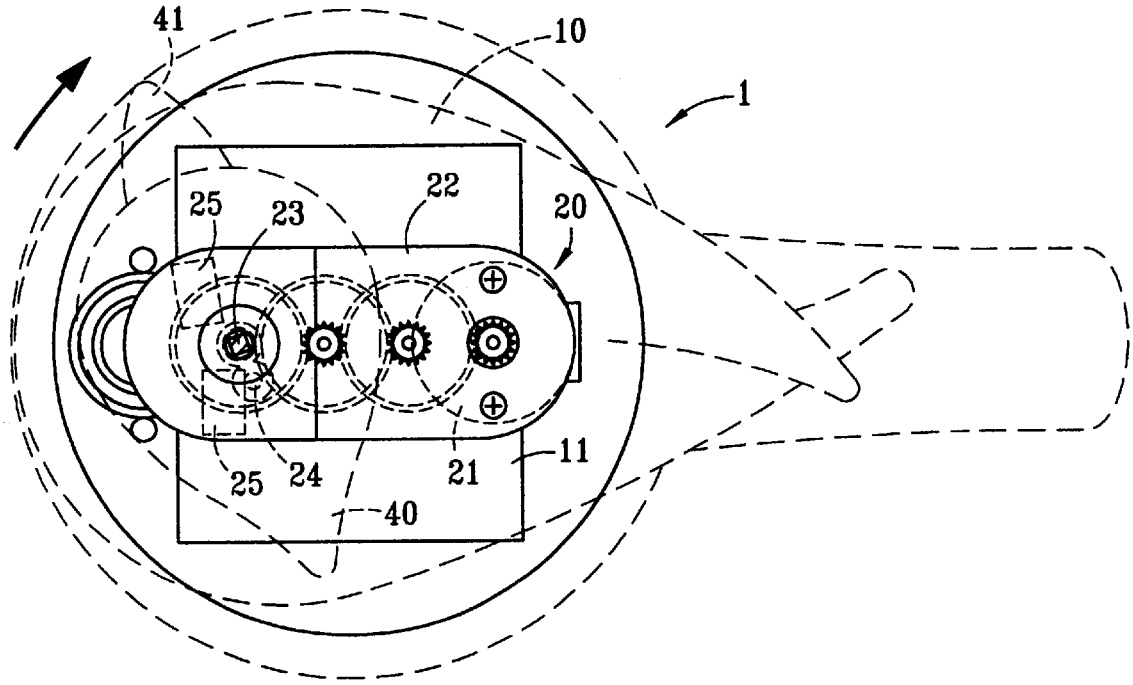
FIG. 4 is a top view of the animated toy animal of FIG. 1, showing a head part wagged to a side.
Figure 5:
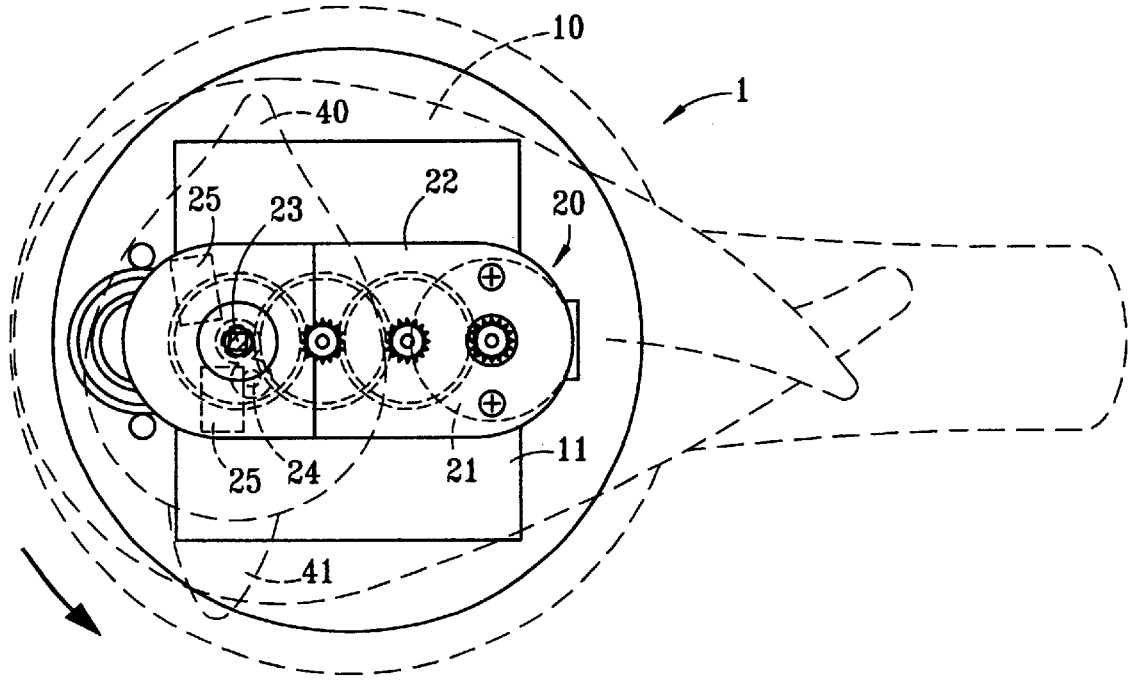
FIG. 5 is a top view of the animated toy animal of FIG. 1, showing the head part wagged to the side opposite to that shown in FIG. 4.

Head part 40 is wagged side to side relative to body part 10 because the upright axle 23 is driven by reciprocal motor 21, through speed reducer 22, in the angular range restrict by stops 25 and stub 24, as shown in FIGS. 4 and 5.

During the meantime, neckerchief 42 extending downward from head part 40 will conceal the seam between body part 10 and head part 40, no matter whether head part 40 is wagged or kept still. It is preferable that neckerchief 42 is made of PVC (polyvinyl chloride) in imitation of feather or fur based on the real animal which the inventive toy animal is designed to imitate.

As shown in FIG. 1, the inventive toy animal may further includes detector 13 which is disposed in body part 10, in order to turn on the toy animal automatically by detecting the presence of any person passing by or standing in front. The tune or the repeated twittering sounds will then be played, while head part 40 is wagged and lower mandible 36 is moved.

From the above description, it is noted that the invention has the following advantages including animation because head part 40 can be wagged side to side and lower mandible 36 can be moved upward and downward, especially in harmony with the rhythm of the tune or the repeated twittering sounds. Also, there is a strong resemblance to the real animal in appearance because neckerchief 42 conceals the seam between the body part 10 and head part 40.

It is to be understood, however, that even though numerous characteristics and advantages of the present utility model have been set forth in the foregoing description, together with details of the structure and function of the utility model, the disclosure is illustrative only, and changes may be made in detail, especially in matters of shape, size, and arrangement of parts within the principles of the utility model to the full extent indicated by the broad general meaning of the terms in which the appended claims are expressed.

What is claimed is:

1. An animated toy animal comprising:

a hollow shell configured as a real animal and having a body part and a head part, said head part having an upper mandible and a lower mandible movable relative to said upper mandible;

a neckerchief extending downward from said head part to conceal a seam between said parts;

means arranged in said body part for wagging said head part side to side relative to said body part; and means arranged in said head part for moving said lower mandible upward and downward relative to said upper mandible.

2. The animated toy animal as claimed in claim 1, wherein said means for wagging includes:

a disk for supporting said head part;

an upright axle having a top end and a bottom end, said upright axle being connected at said top end to said disk; and a reciprocating motor for driving said upright axle side to side relative to said body part.

3. The animated toy animal as claimed in claim 2, wherein said means for wagging further includes a speed reducer through which said upright axle is driven by said reciprocating motor.

4. The animated toy animal as claimed in claim 3, wherein said upright axle has a stub formed at said bottom end thereof, and wherein said speed reducer has a pair of spaced stops engageable with said stub, thereby limiting the rotation of said shaft and hence the head part to an angular range.

5. The animated toy animal as claimed in claim 1, wherein said means for moving includes:

a lever having a first end and a second end, said lever being pivoted on said head part between said ends and being connected at said first end to said lower mandible;

a rotary motor having a spindle;

a cord stretched between said second end of said lever and said spindle; and a spring element stretched between said second end of said lever and an inner wall of said head body.

6. The animated toy animal as claimed in claim 5, wherein said lever has a branch formed with a distal end attached to said neckerchief in a location below said lower mandible.

7. The animated toy animal as claimed in claim 6, wherein said lever has a piece of soft material intervening between said distal end of said branch and said neckerchief.

8. The animated toy animal as claimed in claim 1, wherein said body part has an electrical power supply and a switch disposed therein.

9. The animated toy animal as claimed in claim 1, wherein said body part has a detector disposed therein.

10. The animated toy animal as claimed in claim 1, wherein said neckerchief is made of polyvinyl chloride.

11. Th animated toy animal as claimed in claim 1, wherein said neckerchief is made to imitate feathers.

12. The animated toy animal as claimed in claim 1, wherein said neckerchief is made to imitate fur.

* * * * *